US008731230B2

(12) United States Patent
Peng et al.

(10) Patent No.: US 8,731,230 B2
(45) Date of Patent: May 20, 2014

(54) LOUDSPEAKER STRUCTURE WITH INNER FRAME

(75) Inventors: Jack Peng, Taoyuan (TW); Yeh-Feng Chou, Taoyuan (TW)

(73) Assignee: Meiloon Industrial Co., Ltd., Taoyuan (TW)

( * ) Notice: Subject to any disclaimer, the term of this patent is extended or adjusted under 35 U.S.C. 154(b) by 379 days.

(21) Appl. No.: 13/205,724

(22) Filed: Aug. 9, 2011

(65) Prior Publication Data

US 2013/0039528 A1 Feb. 14, 2013

(51) Int. Cl.
*H04R 11/02* (2006.01)

(52) U.S. Cl.
USPC ..... 381/407; 381/403; 381/420; 381/413; 381/433; 381/414

(58) Field of Classification Search
USPC ..... 381/403, 405, 407, 420, 413, 433, 414, 381/412
See application file for complete search history.

(56) References Cited

U.S. PATENT DOCUMENTS 5,850,462 A * 12/1998 Sakamoto et al. ..... 381/405
2008/0285787 A1* 11/2008 Szu-Wei ..... 381/409

* cited by examiner

*Primary Examiner* — Davetta W Goins
*Assistant Examiner* — Amir Etesam
(74) *Attorney, Agent, or Firm* — Jackson IPG PLLC

(57) ABSTRACT

A loudspeaker includes an outer frame with an annular magnet partially exposed from a bottom thereof; a voice coil located inside the annular magnet; a diaphragm glued to between an expanded front opening of the outer frame and the voice coil; a flexible suspension ring having an outer edge fixed to a stepped section of the outer frame and a central opening edge clearance-fitted to a middle/front portion of the annular magnet; and an inner frame having a front portion fitted around the voice coil, a rear portion located on the central opening edge of the flexible suspension ring, and legs extended between the front and rear portions to locate in front of slots formed on the annular magnet. Therefore, the loudspeaker has reduced depth and volume, increased vibration amplitude and stability, and high quality sound output.

4 Claims, 5 Drawing Sheets

LOUDSPEAKER STRUCTURE WITH INNER FRAME

FIELD OF THE INVENTION

The present invention relates to a loudspeaker structure with inner frame, and more particularly to a loudspeaker that has effectively reduced depth and volume in a fully assembled state, and includes an inner frame that helps to stable vibration of voice coil and properly enhances bass response to output high quality sound.

BACKGROUND OF THE INVENTION

The new-generation liquid-crystal television (LCD TV) has largely reduced thickness and volume compared to the conventional television set. To satisfy consumers' constant demands for high quality audio and video output, the LCD TV must be equipped with not only high quality audio/video devices, but also good loudspeakers that are terminal output devices forming an important factor in the quality of output sound.

FIG. 1 is an assembled sectional view showing the structure of a conventional loudspeaker. As shown, the loudspeaker includes a basket having an expanded front opening, and an annular magnet mounted to a bottom of the basket, a voice coil located inside the annular magnet, a diaphragm glued to between the expanded front opening of the basket and the voice coil, and a flexible suspension ring located behind and spaced from the diaphragm. While the conventional loudspeaker with the above structure provides good sound quality, it has a relatively big volume in a fully assembled state and is therefore not suitable for mounting in the LCD TV that has a very limited inner space. In the event the conventional loudspeaker is reduced in size to match the small inner space of the LCD TV, the sound wave output by the size-reduced loudspeaker would fail to effectively lower its lowest resonant frequency. As a result, the output sound is adversely affected and the LCD TV fails to provide the consumer with good visual and audio pleasure at the same time.

SUMMARY OF THE INVENTION

A primary object of the present invention is to provide a loudspeaker structure with inner frame, so as to effectively reduce the depth and volume of the loudspeaker in a fully assembled state and upgrade the output sound quality thereof.

To achieve the above and other objects, the loudspeaker structure with inner frame according to the present invention includes an outer frame having an expanded front opening and a bottom with an annular magnet mounted thereto, a voice coil located inside the annular magnet, and a diaphragm having an outer edge fixed to a rim of the expanded front opening of the outer frame and an inner edge glued to the voice coil. The loudspeaker structure of the present invention is characterized by a flexible suspension ring and an inner frame. The flexible suspension ring has an outer edge fixed to an internal stepped section of the outer frame and a central opening edge clearance-fitted to a sidewall of the annular magnet. The annular magnet is provided on a front end with a plurality of axially extended and circumferentially spaced slots. The inner frame has a front portion fitted around a sidewall of the voice coil, a rear portion located on the central opening edge of the flexible suspension ring, and a plurality of legs extended to between the front and the rear portion of the inner frame. The legs are correspondingly located in front of the slots on the annular magnet.

With these arrangements, the loudspeaker in a fully assembled state can have effectively reduced depth and overall volume, and the flexible suspension ring can be located inner in the outer frame to fit to a middle portion or a front portion of the sidewall of the annular magnet. Further, the inner frame helps the voice coil to stably vibrate forward and backward, and the legs of the inner frame can move in and out of the slots on the front end of the annular magnet without hindering the forward and backward vibration of the voice coil, so that the loudspeaker can have properly increased vibration amplitude and vibration stability to enhance bass response and upgrade output sound quality.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
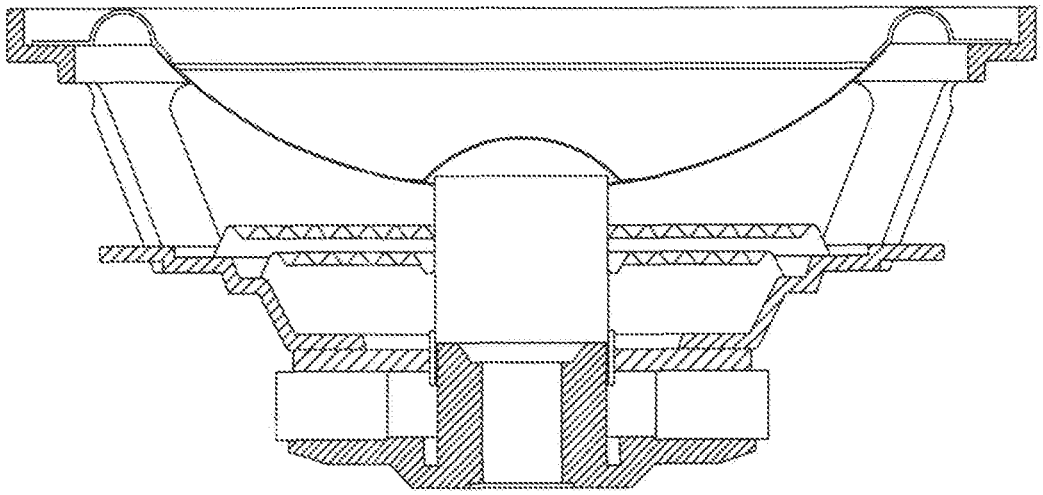
FIG. 1 PRIOR ART
FIG. 1 is an assembled sectional view showing the structure of a conventional loudspeaker.
Figure 2:
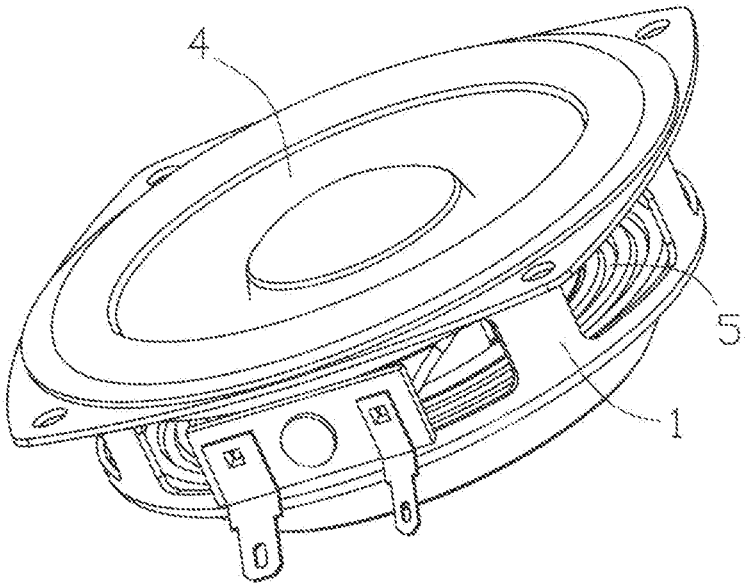
FIG. 2 is an assembled perspective view of a loudspeaker structure with inner frame according to the present invention.

The present invention will now be described with some preferred embodiments thereof and with reference to the accompanying drawings. Please refer to FIGS. 2 to 4. A loudspeaker structure with inner frame according to the present invention includes an outer frame 1 (i.e. a basket) having an expanded front opening 11 and a bottom with an annular magnet 2 mounted thereto, a voice coil 3 located inside the annular magnet 2, and a diaphragm 4 having an outer edge fixed to a rim of the expanded front opening 11 of the outer frame 1 and an inner edge glued to the voice coil 3.

The loudspeaker structure of the present invention is characterized by a flexible suspension ring 5 (i.e., a spider) and an inner frame 6. The flexible suspension ring 5 has an outer edge 51 fixed to an internal stepped section 12 of the outer frame 1 and a central opening edge 52 clearance-fitted to a sidewall 21 of the annular magnet 2. The annular magnet 2 is provided on a front end with a plurality of axially extended and circumferentially spaced slots 22. The inner frame 6 has a front portion fitted around a sidewall of the voice coil 3, a rear portion located on the central opening edge 52 of the flexible suspension ring 5, and a plurality of legs 61 extended to between the front and the rear portion of the inner frame 6. The legs 61 are correspondingly located in front of the slots 22 on the annular magnet 2.

Figure 3:
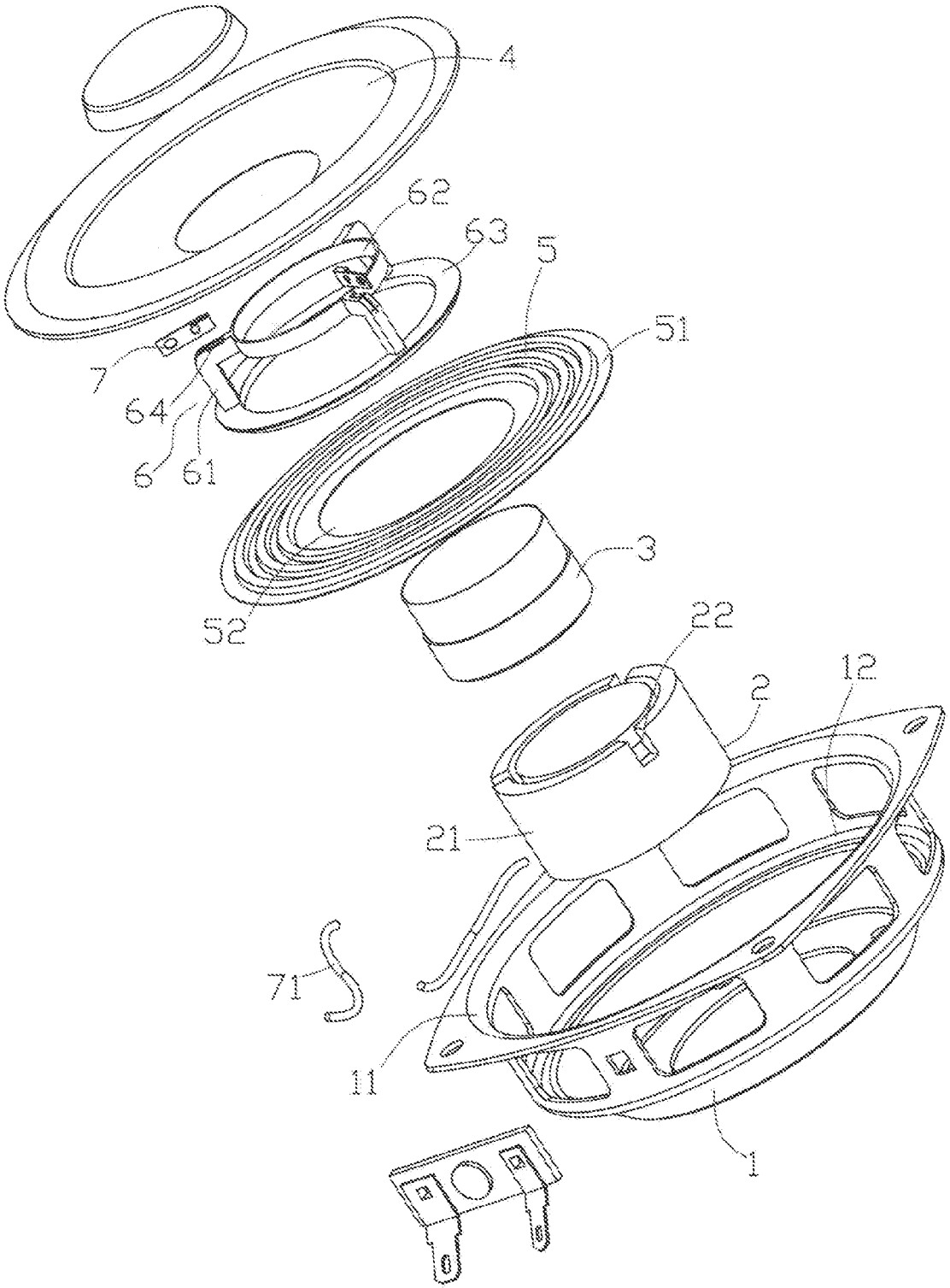
FIG. 3 is an exploded view of FIG. 2.
Figure 4:
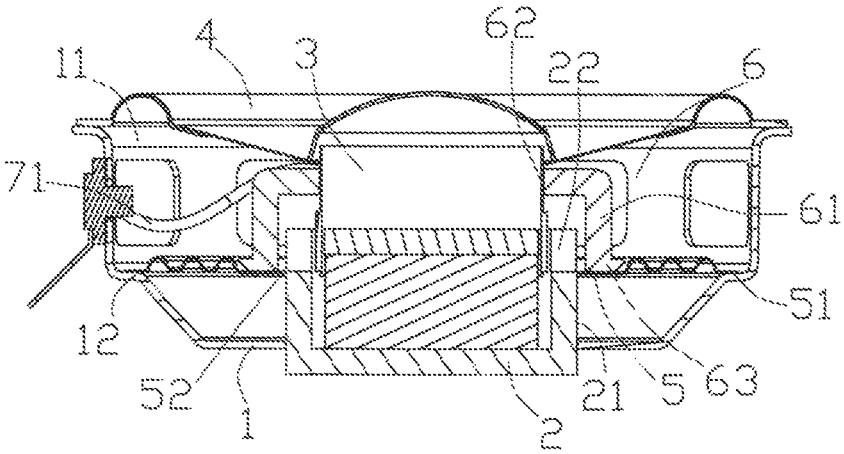
FIG. 4 is an assembled sectional view of FIG. 2.

As can be seen from FIGS. 3 and 4, the flexible suspension ring 5 is located inner in the outer frame 1 with the central opening edge 52 thereof clearance-fitted to a middle portion or a front portion of the sidewall 21 of the annular magnet 2. There are three axial slots 22 equally circumferentially spaced on the front end of the annular magnet 2. The inner frame 6 is in the form of a forward protruded round frame, such that the front portion of the inner frame 6 is a front fitting ring 62 having a smaller diameter for gluing to the sidewall of the voice coil 3 and the rear portion is a rear flange 63 having a larger diameter for gluing to the central opening edge 52 of the flexible suspension ring 5. There are three equally spaced reverse L-shaped legs 61, which outward extend between the front fitting ring 62 and the rear flange 63 to locate in front of and align with the three slots 22 on the front end of the annular magnet 2. On the legs 61 of the inner frame 6, there are provided with slits 64 for conducting tags 7 to insert thereinto, so that the conducting tags 7 serve as soldering points for two lead wires 71 of the loudspeaker structure to connect thereto.

When the loudspeaker is fully assembled, the annular magnet 2 is mounted to the outer frame 1 to partially expose from the bottom thereof, and the flexible suspension ring 5 is clearance-fitted to the middle portion or the front portion of the sidewall 21 of the annular magnet 2 to locate at an inner position in the outer frame 1. With these arrangements, the loudspeaker structure in a fully assembled state can have effectively reduced depth and overall volume and can be advantageously mounted in an LCD TV, which has a very limited internal space, and other electronic devices that also have constantly reduced dimensions in design. Further, with the inner frame 6, the voice coil 3 can vibrate stably to produce good acoustic resonance.

Figure 5:
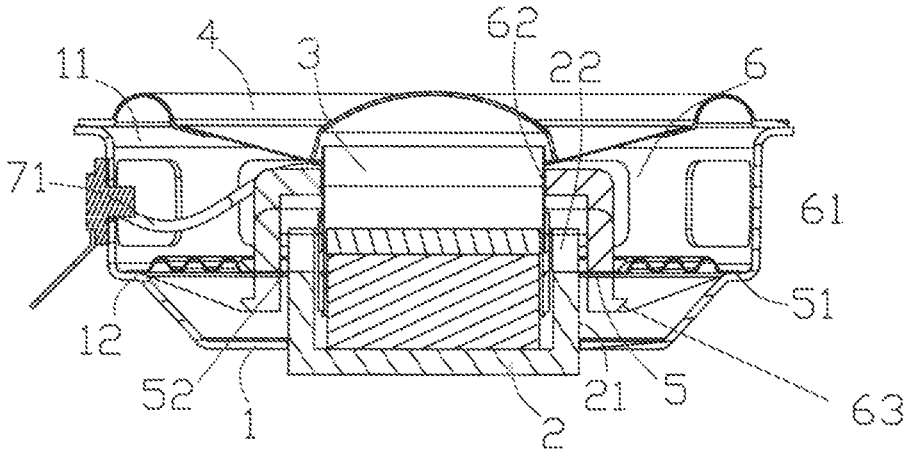
FIG. 5 is an assembled sectional view showing the loudspeaker structure according to the present invention in operation.

FIG. 5 shows the loudspeaker structure of the present invention in operation. As can be seen from FIGS. 4 and 5, the flexible suspension ring 5 is clearance-fitted to the middle portion or the front portion of the sidewall 21 of the annular magnet 2 to locate at an inner position in the outer frame 1, the inner frame 6 is provided between and connected to the flexible suspension ring 5 and the voice coil 3, and the legs 61 of the inner frame 6 are aligned with and located in front of the slots 22 on the front end of the annular magnet 2. When the loudspeaker outputs sound, the inner frame 6 advantageously helps to the forward and backward vibration of the voice coil 3, and the legs 61 of the inner frame 6 can move in and out of the slots 22 on the front end of the annular magnet 2 without hindering the forward and backward vibration of the voice coil 3 in the annular magnet 2. That is, with the inner frame 6, the forward and backward movement (or piston movement) of the voice coil 3 can have good elastic compliance to vibrate stably, which properly increases the vibration amplitude and vibration stability of the loudspeaker structure, enhances bass response to produce good acoustic resonance, and well coordinates power and sound wave to ensure upgraded sound quality.

In conclusion, with the present invention, the loudspeaker structure in a fully assembled state has effectively reduced depth and overall volume, and the inner frame 6 helps to the stable vibration of the voice coil 3 and properly enhances bass response for the loudspeaker to output perfect sound quality.

The present invention has been described with a preferred embodiment thereof and it is understood that many changes and modifications in the described embodiment can be carried out without departing from the scope and the spirit of the invention that is intended to be limited only by the appended claims.

What is claimed is:

1. A loudspeaker structure with inner frame, comprising:

an outer frame having an expanded front opening and a bottom;

an annular magnet flexibly mounted to the outer frame and provided on a front end with a plurality of circumferentially spaced and axially extended slots;

a voice coil located inside the annular magnet;

a diaphragm having an outer edge fixed to a rim of the expanded front opening of the outer frame and an inner edge fixed to the voice coil;

a flexible suspension ring having an outer edge fixed to an internal stepped section of the outer frame and a central opening edge clearance-fitted to a sidewall of the annular magnet so as to flexibly couple the annular magnet and the outer frame; and an inner frame having a front portion fixed to a sidewall of the voice coil, a rear portion fixed to the central opening edge of the flexible suspension ring, and a plurality of legs extending between the front and the rear portion of the inner frame and aligned with the slots formed on the front end of the annular magnet such that the legs of the inner frame can move in and out of the slots on the front end of the annular magnet without hindering the forward and backward vibration of the voice coil in the annular magnet, so that bass response is enhanced.

2. The loudspeaker structure with inner frame as claimed in claim 1, wherein the annular magnet mounted to the bottom of the outer frame is partially exposed from the bottom of the outer frame, and the central opening edge of the flexible suspension ring is clearance-fitted to a middle portion or a front portion of the annular magnet.

3. The loudspeaker structure with inner frame as claimed in claim 2, wherein the axially extended slots provided on the front end of the annular magnet are three in number and are circumferentially equally spaced from one another; and wherein the inner frame is a forward protruded round frame, of which the front portion being a front fitting ring having a smaller diameter, the rear portion being a rear flange having a larger diameter, and the legs being reverse L-shaped to outward extend between the front fitting ring and the rear flange and being three in number to circumferentially equally spaced from one another.

4. The loudspeaker structure with inner frame as claimed in claim 3, wherein the legs of the inner frame have slits formed thereon for receiving conducting tags therein, and the conducting tags serving as lead wire soldering points in the loudspeaker structure.

* * * * *